US005464200A

United States Patent [19]

Nakazato et al.

[11] Patent Number: 5,464,200

[45] Date of Patent: Nov. 7, 1995

[54] SHEET STORING DEVICE WITH LOCKING BINS

[75] Inventors: Yasushi Nakazato, Tokyo; Makoto Tanaka, Kamakura; Kohki Sakamoto, Yokohama; Hisayo Kondo, Tokyo; Rikio Kasahara, Yokohama; Hiroyuki Shibaki, Yokohama; Mitsugu Sugiyama, Yokohama, all of Japan

[73] Assignee: Ricoh Company, Ltd., Tokyo, Japan

[21] Appl. No.: 228,376

[22] Filed: Apr. 15, 1994

[30] Foreign Application Priority Data

Apr. 15, 1993 [JP] Japan ..... 5-112249
Apr. 16, 1993 [JP] Japan ..... 5-090141

[51] Int. Cl.[6] ..... B42C 1/12; B05G 1/00; B65H 39/10

[52] U.S. Cl. ..... 270/53; 270/58; 109/57; 271/297

[58] Field of Search ..... 270/53, 58; 355/323, 355/324; 271/288, 297, 298, 311, 279; 414/273, 276, 270, 790.9, 791.1; 109/55, 56, 57

[56] References Cited

U.S. PATENT DOCUMENTS 3,884,408 5/1975 Leiter et al. ..... 270/58 X
4,248,525 2/1981 Sterrett ..... 270/58 X
4,428,572 1/1984 Burke ..... 271/297
4,470,356 9/1984 Davis et al. ..... 109/24.1
4,561,765 12/1985 Masuda ..... 271/288 X
4,768,767 9/1988 Orr et al. ..... 270/58
5,176,372 1/1993 Nakajima ..... 270/58 X
5,263,707 11/1993 Kuzumi ..... 271/293
5,328,170 7/1994 Coombs et al. ..... 109/53 X
5,342,034 8/1994 Mandel et al. ..... 270/58 X
5,358,238 10/1994 Mandel et al. ..... 271/298

OTHER PUBLICATIONS

IBM Technical Disclosure Bulletin, vol. 18, No. 19, Feb. 1976, Cralle et al.
IBM Technical Disclosure Bulletin, vol. 24, No. 7B, Dec. 1981, Bartholet et al.

*Primary Examiner*—John E. Ryznic
*Attorney, Agent, or Firm*—Oblon, Spivak, McClelland, Maier & Neustadt

[57] ABSTRACT

In a device for storing printings, film sheets or similar recording media driven out or an image forming apparatus, bins are each inclined from a top sheet inlet thereof to a bottom sheet outlet thereof. When all the bins are full, such a condition is reported to users. Users having left sheets in the trays for a long period of time are alerted by a warning message. Sheets become needless for users can be automatically disposed of by commands from user stations. A user passes an I.D. card through a card reader to enter an I.D. number, opening a bin corresponding to the I.D. number, dropping the sheet onto a fence for user access.

12 Claims, 16 Drawing Sheets

SHEET STORING DEVICE WITH LOCKING BINS

BACKGROUND OF THE INVENTION

The present invention relates to a copier, printer, facsimile apparatus or similar image forming apparatus and, more particularly, to a device for storing printings, film sheets or similar recording media driven out or an image forming apparatus.

It is a common practice with, for example, a printer to provide a sheet discharging device implemented by a plurality of trays. A printer whose trays are each usable as a job separator or a mail box is conventional. Job separators refer to a function of discharging a series of printings (called a job hereinafter) while separating them from the others, while mail boxes refer to a function of allocating each tray to a particular user and distributing printings to the individual trays. The sheet discharging device has a plurality of trays arranged one above another in the same way as the trays of a sorter or stacker for a copier, as disclosed in, for example, Japanese Patent Laid-Open Publication No. 63-60870.

With a copier, it is a common practice for the operator to manipulate the copier while standing by the copier, so that sheets can be taken out of a sorter or a stacker easily. On the other hand, a printer connected to a network and capable of producing a great amount of printings is usually controlled at individual remote stations. Moreover, the printer for network use is generally shared by a great number of users, e.g., several tens to several thousands of person in a LAN (Local Area Network) or similar network environment. This kind of printer has a problem when implemented with a stack of trays of the same type as conventionally applied to the sorter or stacker of a copier. Specifically, although the trays may be used as job separators, it is difficult for a user to locate one of the trays received printings (job) which the user commanded. Should the user inadvertently take out printings meant for another user, not only printings addressed to the user would be left in the device, but also the other users would suffer damage in the secrecy aspect. Furthermore, when more than a hundred users share the printer, it is difficult to implement mail boxes, i.e., to provide the same number of trays as the number of users. In addition, providing such a great number of mail boxes is wasteful since not all the users command printing at all times, i.e., most mail boxes remain empty at all times. It is also difficult to change the number of trays. Moreover, considering the fact that the number of users sharing the same printer constantly changes, it is difficult to determine how many trays should be attached to the printer at the time of purchase. Hence, the printer suffers from a lack in expansibility and flexibility.

SUMMARY OF THE INVENTION

It is, therefore, an object of the present invention to provide a sheet storing device capable of storing sheets by using bins thereof efficiently.

It is another object of the present invention to provide an extremely simple sheet storing device.

It is another object of the present invention to provide a miniature, light weight and inexpensive sheet storing device by reducing the number of parts.

It is another object of the present invention to provide a sheet storing device which is easy to operate and manage.

It is another object of the present invention to provide a sheet storing device which is desirable in respect of secrecy.

A sheet storing device of the present invention comprises a plurality of bins each for storing incoming sheets while sorting the sheets, sheet introducing members for selectively introducing the sheets into the bins, and sheet discharging members for selectively discharging sheets from the bins. The sheet introducing members and the sheet discharging members are operable asynchronously to each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
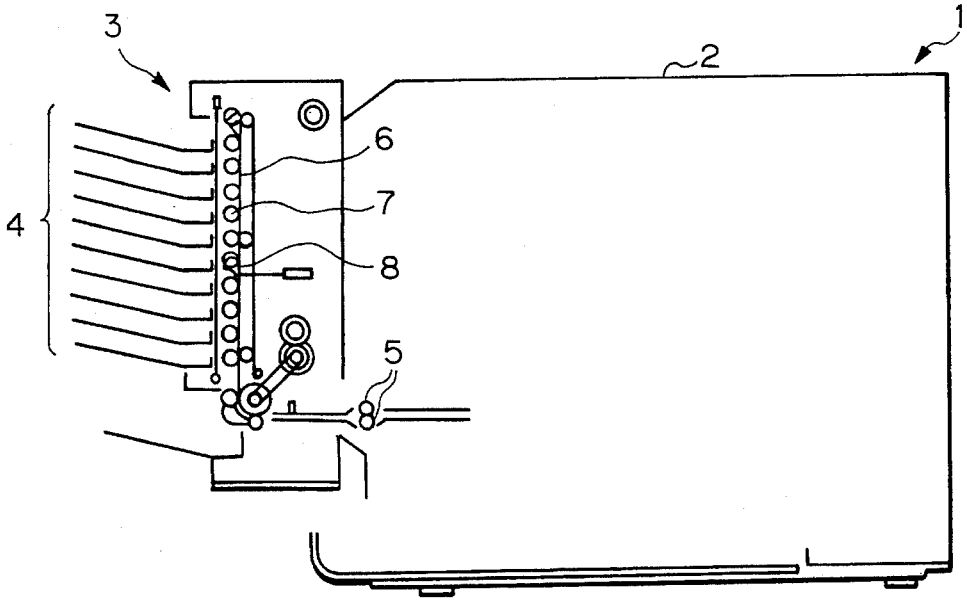
Fig. 1 PRIOR ART
FIG. 1 is a fragmentary section of a conventional printer having a sorter.

To better understand the present invention, a brief reference will be made to a conventional printer having a sorter which is a specific form of a sheet discharging device and implemented by a plurality of trays, shown in FIG. 1. As shown, the printer, generally 1, has a body 2 and a sorter 3 mounted on the body 2. The sorter 3 has a plurality of (ten in this case) bins or trays 4 for storing sheets. A sheet, not shown, is driven out of the body 2 by a discharge roller pair 5, conveyed by a belt 6 and rollers 7, and then distributed to a particular bin 4 by a pawl 8. When a plurality of computers are connected to the printer 1 in a network configuration, the bins 4 are each assigned to one computer and receives respective sheets or printings.

The problem with the printer 1 is that since the sorter 3 has only ten trays 4, no more than ten persons can share the printer 1. That is, the limited number of trays 1 directly translates into the limited number of users capable of sharing the printer 1.

Figure 2:
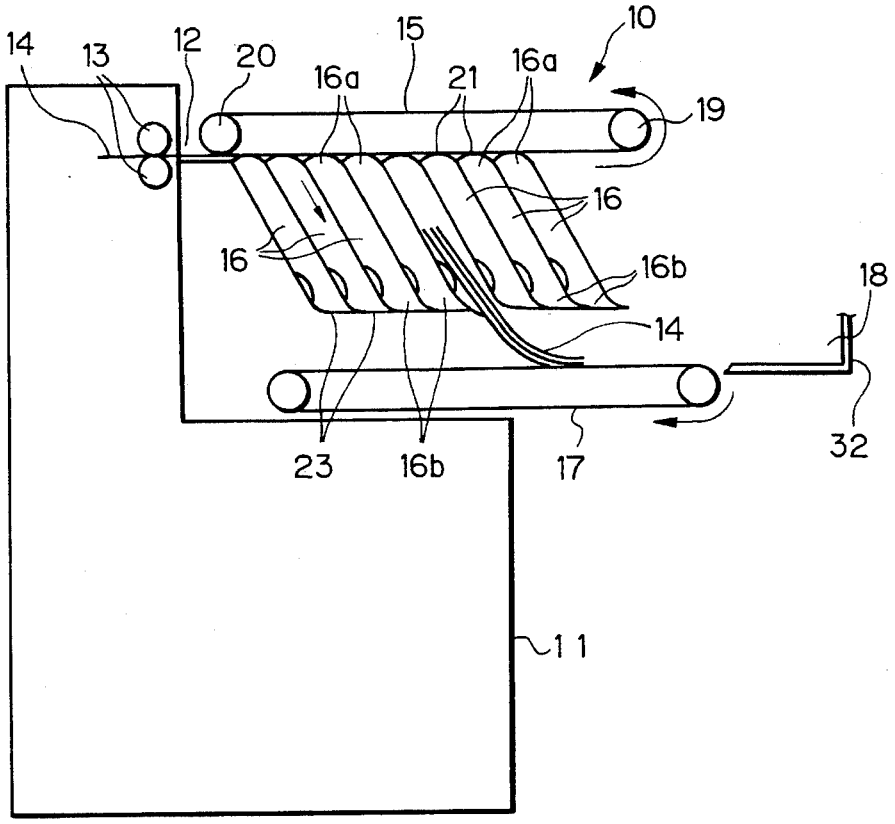
FIG. 2 is a section showing a sheet storing device embodying the present invention and mounted on an image forming apparatus.
Figure 3:
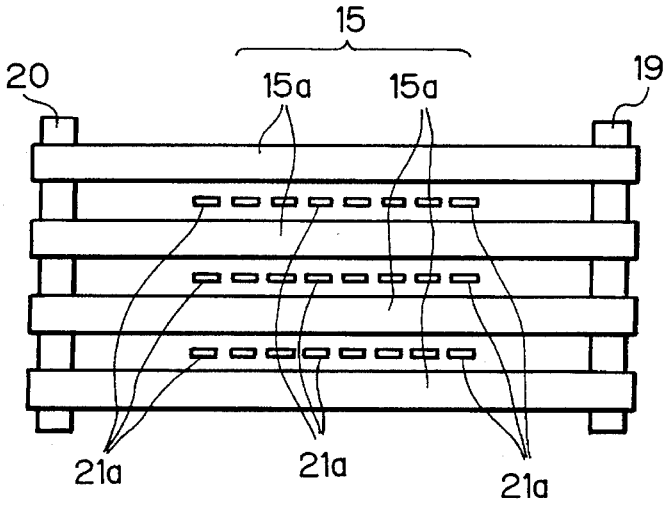
FIG. 3 is a plan view indicative of a relation between an upper conveyor belt and a lower conveyor belt included in the embodiment.

Referring to FIG. 2, a sheet storing device embodying the present invention is shown and applied to a copier, printer or similar image forming apparatus. As shown, the sheet storing device, generally 10, is positioned outside of a sheet outlet 12 which is formed in the image forming apparatus 11. A sheet 14 is driven out of the apparatus 11 by a discharge roller pair 13 via the outlet 12. The device 10 has an upper conveyor belt 15 disposed above and extending along an imaginary horizontal line that extends from the outlet 12, a plurality of bins 16 arranged along and below the horizontal line, and a lower conveyor belt 17 disposed below the bins 16 in parallel to the upper conveyor belt 17. The lower conveyor belt 17 terminates at a sheet take-out opening 18. As shown in FIG. 3, the upper belt 15 is implemented as a plurality of parallel endless belts 15*a* which are passed over a front and a rear pulley 19 and 20, respectively, and spaced apart a predetermined distance from each other.

Figure 4:
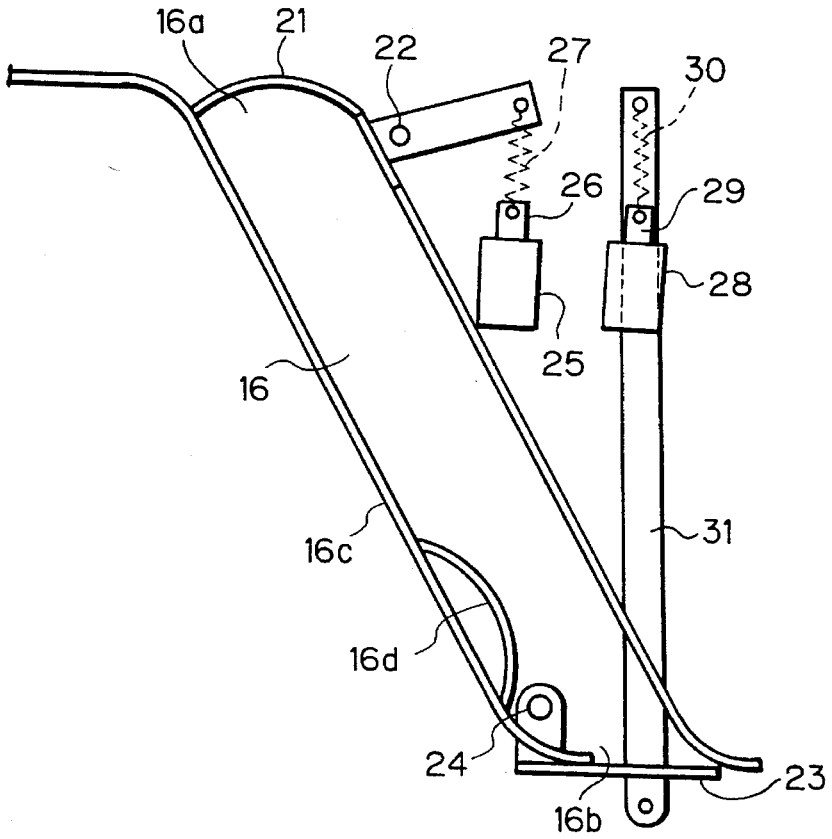
FIG. 4 is a sectional side elevation of bins, upper gates and lower gates also included in the embodiment.
Figure 5:
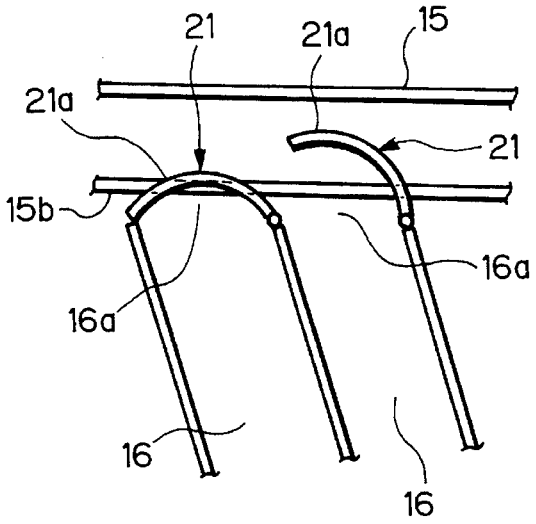
FIG. 5 is a fragmentary sectional side elevation indicative of a relation between the upper conveyor belt and the upper gates.

The bins 16 adjoin each other in the direction in which the upper belt 15 conveys sheets (front-and-rear direction). A sheet inlet 16*a* and a sheet outlet 16*b* are respectively provided at the top and the bottom of each bin 16. The bins 16 are each inclined forward from the sheet inlet 16*a* to the sheet outlet 16*b* (by an angle of about 30 degrees to 80 degrees). As shown in FIG. 4 specifically, an upper gate 21 is rotatable about a shaft 22 to block and unblock the sheet inlet 16*a*, while a lower gate 23 is rotatable about a shaft 24 to block and unblock the sheet outlet 16*b*. As shown in FIG. 3, each upper gate 21 is divided into a plurality of guide plates 21*a* located between the belts 15*a* which constitute the upper belt 15, so that it blocks and unblocks the associated sheet inlet 16*a* between the adjoining belts 15*a*. FIG. 5 shows one upper gate 21 blocking the associated sheet inlet 16*a*, and another upper gate 21 unblocking the associated sheet inlet 16*a*.

Figure 6:
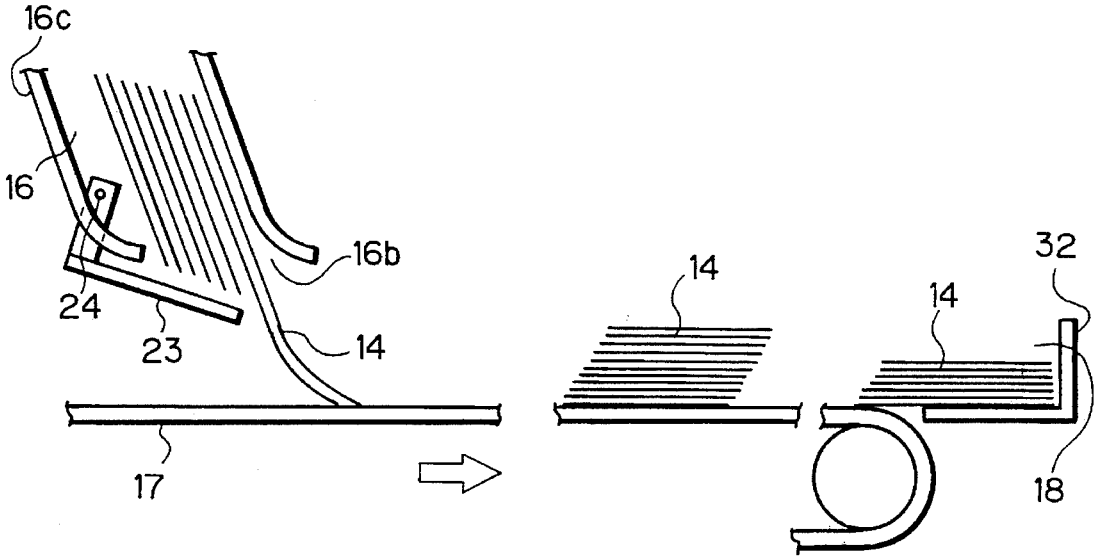
FIG. 6 is a sectional side elevation indicative of a relation between the lower conveyor belt and the lower gates.

The guide plates 21*a* are each convex upward as viewed in a section. When the guide plates 21*a* block the respective sheet inlets 16*a*, they cooperate with the lower run 15*b* of the upper belt 15 to form a transport path and urge the sheet 14 against the run 15*b*. When the guide plates 21*a* unblock the respective sheet inlets 16*a*, they each guides the sheet 14 into the associated sheet inlet 16*a*. As shown in FIG. 6, the lower gates 23 each guides the sheet 14 coming out of the sheet outlet 16*b* toward the lower belt 17 obliquely forward. As shown in FIG. 4, each bin 16 includes a tray portion 16*c* which is provided with a curved projection 16*d*. This projection 16*d* helps the associated lower gate 23 guide the sheet 14 in the above-mentioned manner.

As shown in FIG. 4, each upper gate 21 is connected by a spring 27 to a plunger 26 which extends out from a solenoid 25. In this configuration, the upper gates 21 are actuated by the respective solenoids 25 which are selectively turned o n or turned off. Solenoids 28 are respectively assigned to the lower gates 23, and each has a plunger 29 connected to one gate 23 by a spring 30 and a lever 31.

When the sheet 14 coming out of the image forming apparatus 11 should be received in one of the bins 16, the solenoid 25 assigned to the bin 16 is energized to open the upper gate 21. The sheet 14 is transported along the path defined by the lower run 15*b* of the upper belt 15 and the upper gates 21, while being urged against the belt 15 by the gates 21. The upper gate 21, which is open, guides the sheet 14 into the bin 16. As a result, the sheet 14 is automatically received in the bin 16 by gravity due to the inclination of the bin 16. The successive sheets 14 are sequentially stacked in the bin 16 in this manner. To take out these sheets 14, the solenoid 28 is energized to open the associated lower gate 23. Then, due to the inclination of the bin 16, the sheet 14 is dropped from the bin 16 onto the lower belt 17 by gravity and conveyed by the belt 17 to the sheet take-out opening 18.

As stated above, since the bin 16 is inclined, the sheets 14 can be automatically driven into and then out of the bin 16 only if the associated gates are selectively opened and closed, i.e., without resorting to transporting means which would directly act on the sheets 14. Also, the inclination of the bin 16 allows the sheets 14 to be sequentially stacked on the tray portion 16*c* and, therefore, allows a great number of sheets 14 to be accommodated in the bin 16. Further, since each bin 16 is controlled independently of the others in receiving and discharging the sheets 14, the introduction and discharge of the sheets 14 from the individual bins 16 can be executed at the same time, obviating a waiting time attributable to interference. The curvature of the upper gates 21 and the curved projections 16*d* of the tray portions 16*c*, as well as guide means and auxiliary rollers which may be additionally provided, promote the smooth movement of the sheets 14 into and out of the bins 16.

While the sheet 14 is conveyed toward a desired bin 16, the upper gates 21 urge it against the upper belt 15 while the belt 15 conveys it. This insures stable conveyance without regard to the thickness of the sheet 14, compared to a conventional roller pair and guide means scheme. While an ordinary transport system using a belt retains a sheet on the belt by means of a suction fan or static electricity, the embodiment assigns such a function to the upper gates 21, thereby noticeably reducing the number of parts and cost. Moreover, when the upper gate 21 is in the open or unblocking position, the guide plates 21 constituting the gate 21 are raised between the adjoining belts 15*a*, surely traversing the transport path. Hence, the bin 16 to receive sheets can be switched over surely and stably. While the upper belt 15 has been shown and described as extending horizontally, it may be inclined, if desired.

When the lower gate 23 is opened, the sheets 14 stacked in the bin 16 are smoothly transferred to the lower belt 17 while tilting toward the transport direction of the belt 17. In addition, the sheets 14 are free from damage since they are adequately buffered due to the tension of the belt 17. The transport using the belt 17 allows a stack of sheets to be bodily transported to the sheet take-out opening 18.

Assume that the lower gates 23 are sequentially opened from the downstream side toward the upstream side. Then, as shown in FIG. 6, each sheet stack 14 on the lower belt 17 has the upper part thereof advanced to the downstream side more than the lower part in the transport direction. Hence, only if a fence 32 is provided in the sheet take-out opening 18, each sheet stack 14 has the leading edge thereof automatically regulated into a condition easy to take out.

Figure 7A:
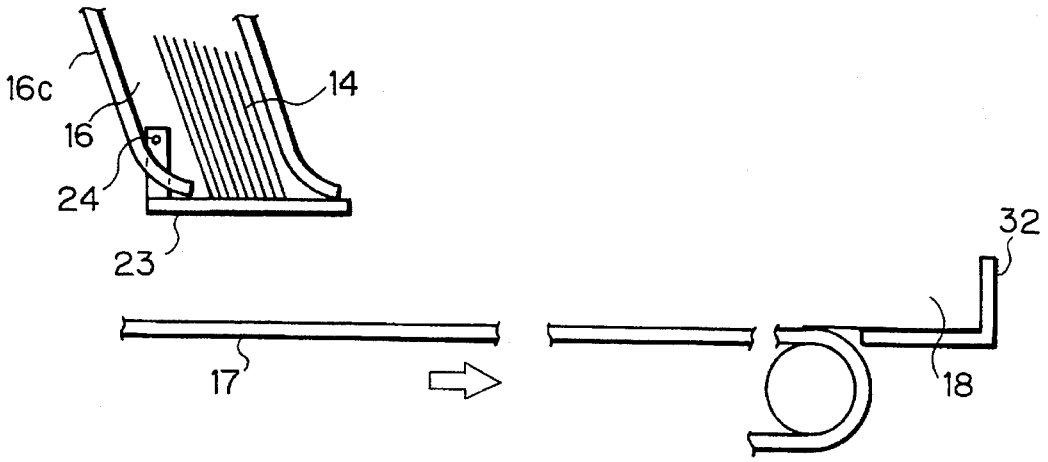
FIGS. 7A–7G are sectional side elevations demonstrating how the lower conveyor belt conveys sheets.
Figure 7B:
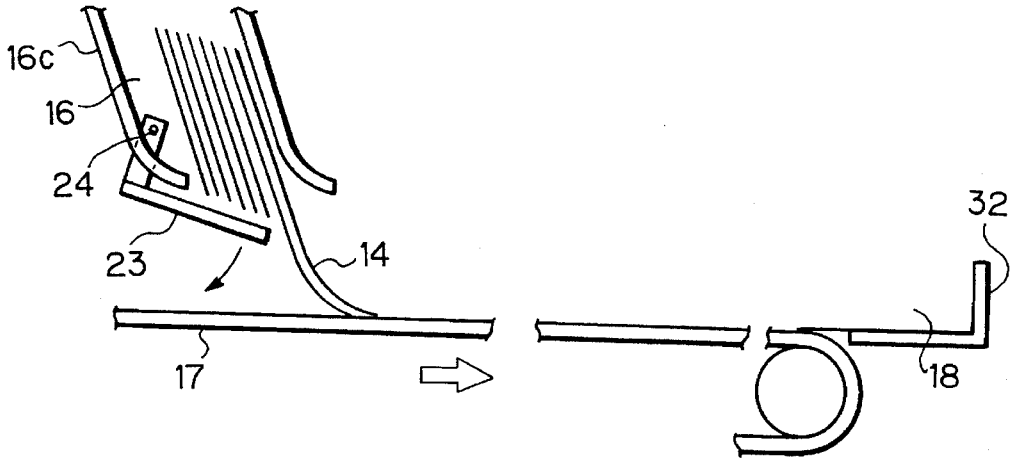
Figure 7C:
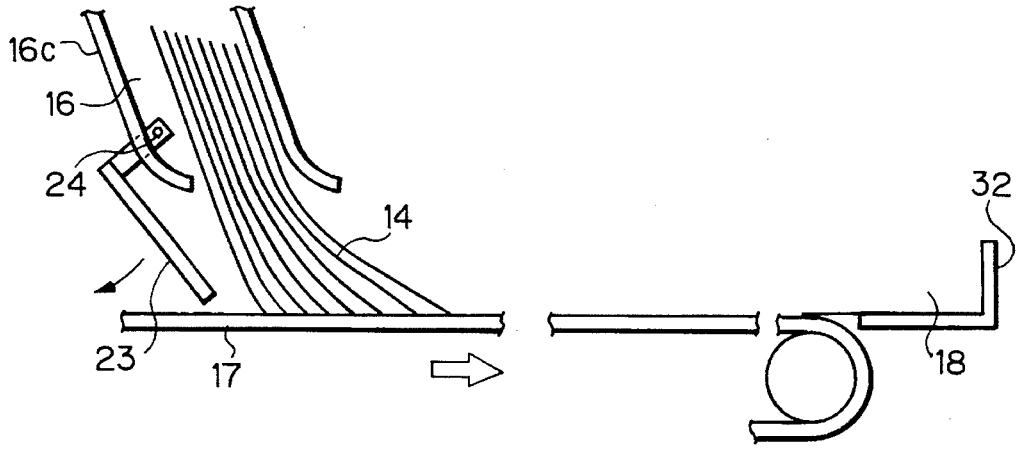
Figure 7D:
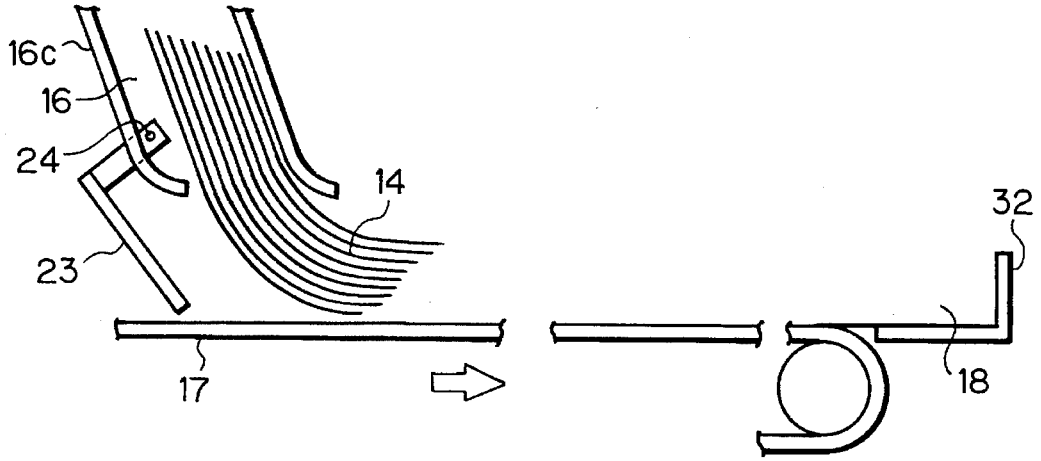
Figure 7E:
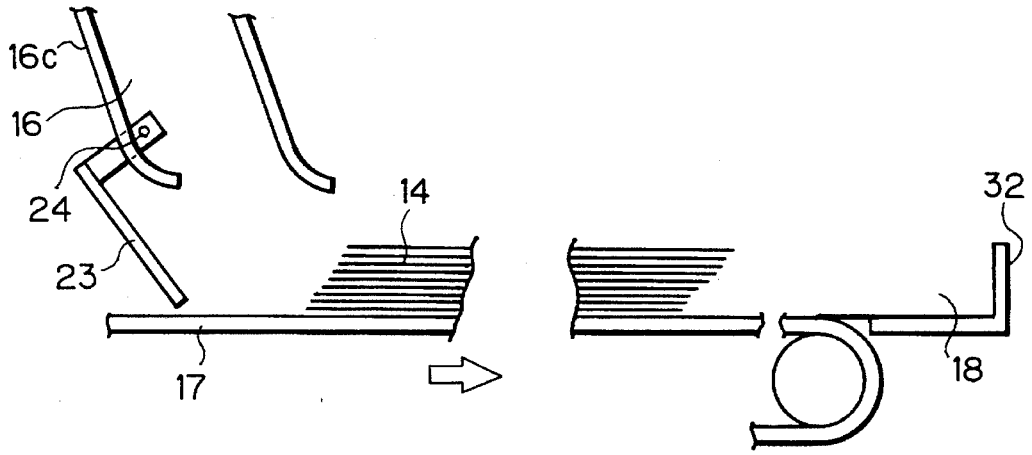
Figure 7F:
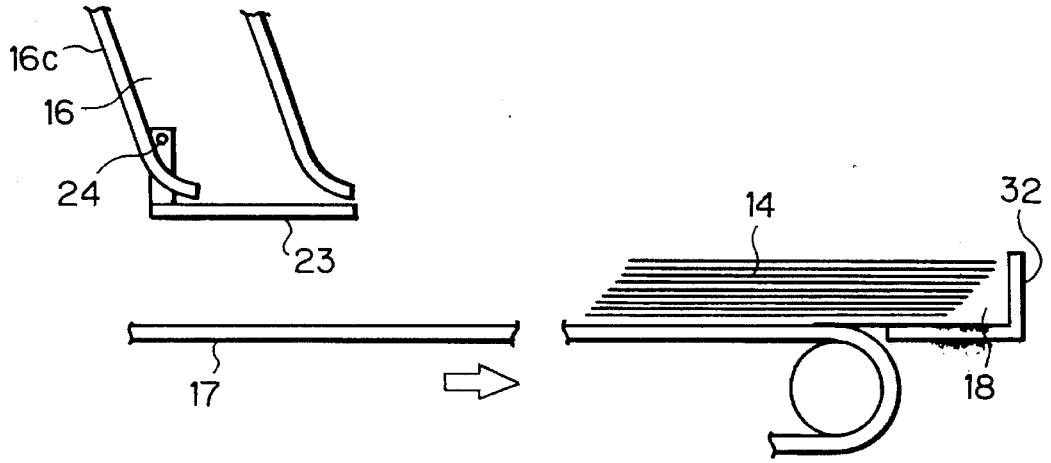
Figure 7G:
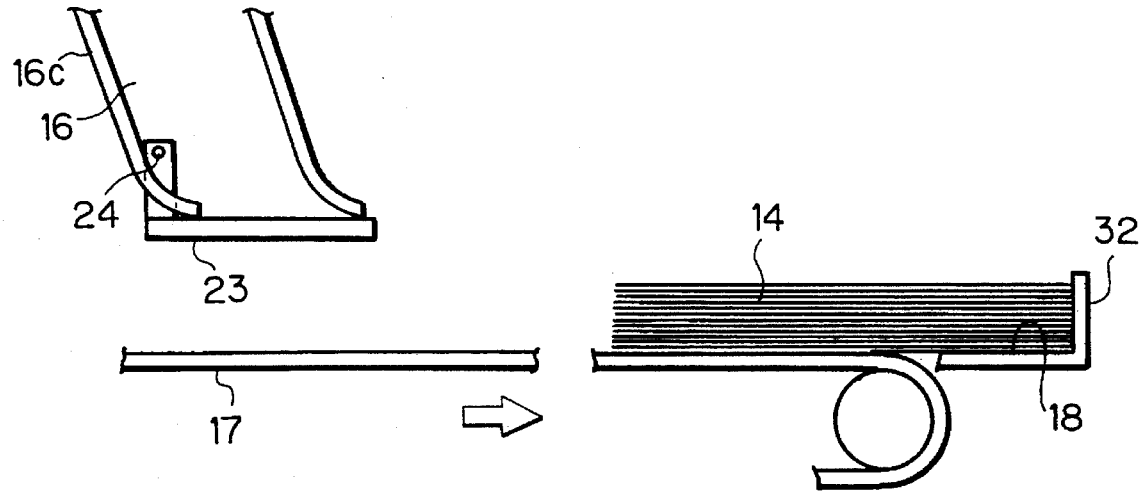

FIGS. 7A–7G demonstrate the above-mentioned procedure in which the sheets 14 stacked in one bin 16 are transferred to the lower belt 17, conveyed by the belt 17, and then abutted against the fence 32. As shown in FIG. 7A, as the lower gate 23 begins to open, the sheets 14 are dropped onto the belt 17 one after another and begin to be transported by the belt 17 (FIG. 7B). As the gate 23 is fully opened (FIG. 7C), all the sheets 14 are loaded on the belt 17 (FIG. 7D). Then, the belt 17 conveys the sheets 14 toward the opening 18 in the unique position shown in FIG. 6 (FIG. 7E). As a result, the leading edges of the sheets 14 abut against the fence 32 one after another (FIG. 7F). Finally, all the sheets 14 are neatly arranged in abutment against the fence 32 (FIG. 7G).

A specific operation of the sheet storing device 10 will be described which uses identification (ID) numbers. Assume that a particular ID number is given to a sheet stack meant for a certain user. Regarding a network printer, for example, it is a common practice to inform a printer of a user ID number assigned to an operator. In such a case, the above-mentioned ID number may be implemented by the user ID number. For a facsimile apparatus, an ID number assigned to a recipient may be entered on an operation panel by use of a confidential function. For a copier, an ID card may be passed through a card reader in the event of copying.

Figure 8:
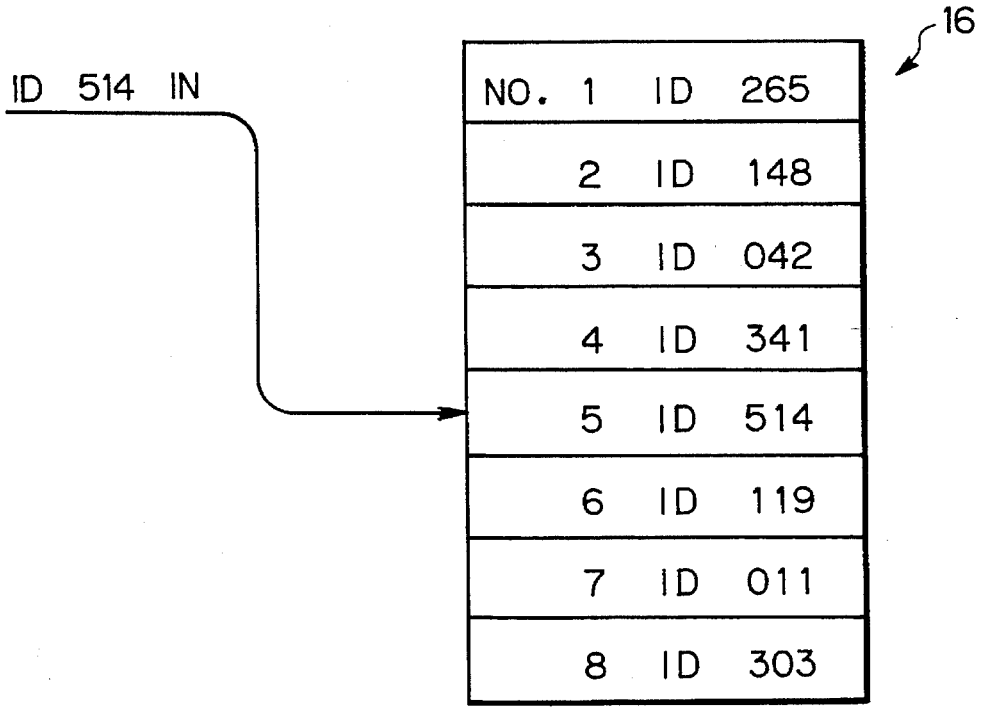
FIG. 8 shows a table listing a specific bin assignment based on ID numbers.
Figure 9:
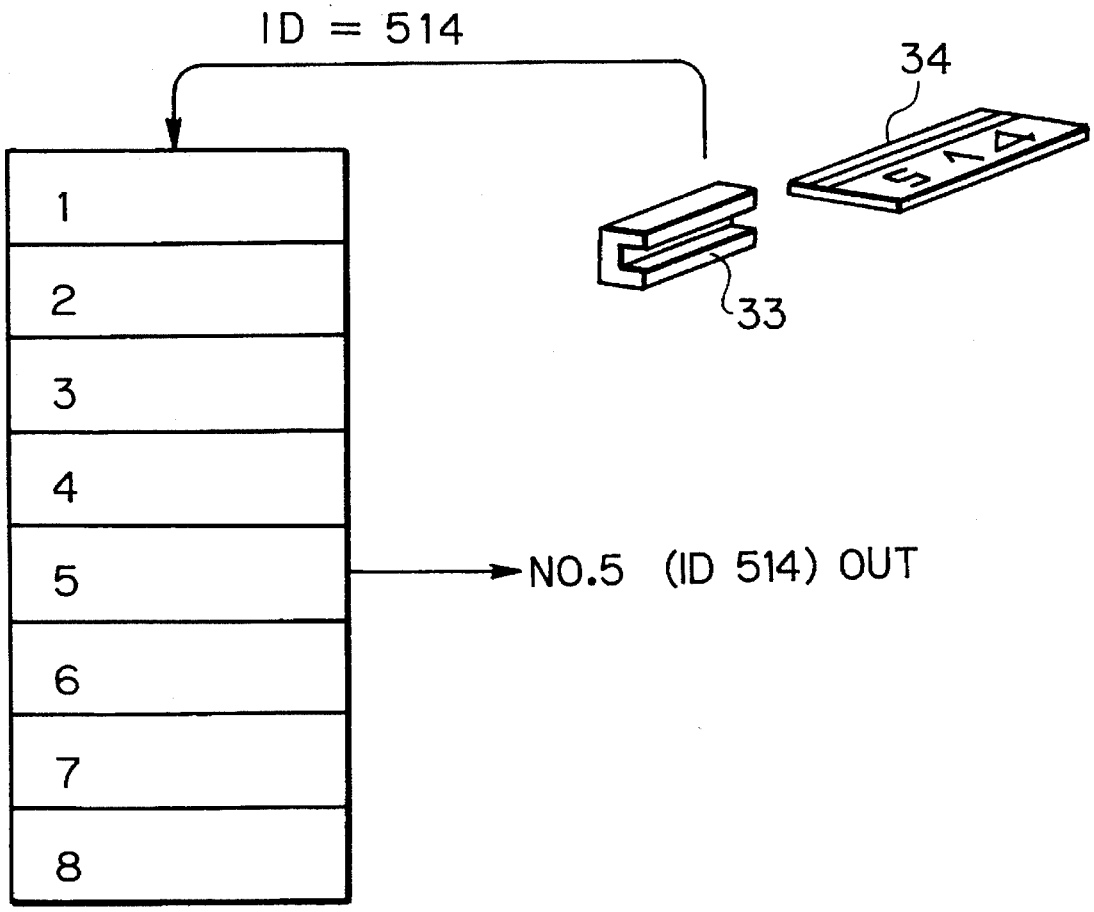
FIG. 9 shows how sheets are taken out by use of an identification (ID) card.

FIG. 8 shows a specific table of ID numbers fixedly assigned one-to-one to sheet stacks to be received in the individual bins 16. The ID number assignment may be set or modified by a system supervisor, as desired. As shown in FIG. 9, to take out a sheet stack, a person passes a card 34 through a card reader 33 which is located in the vicinity of the sheet take-out opening 18.

A conventional device referred to as mail boxes is provided with a plurality of sheet take-out openings each being assigned to a particular user. Each user, therefore, has to remember his own take-out opening at all times. This kind of scheme is also applicable to the illustrative embodiment; a person may remember a number given to his own take-out opening and enter the number in the event of take-out. However, it is likely that the person takes out a sheet stack meant for another person or has a sheet stack addressed to him taken out by another person due to the entry of a wrong number. By contrast, when the control function using ID cards as stated above is applied to the take-out of sheets, troubles due to the entry of wrong numbers are obviated to enhance security control. In addition, ID cards, which are essential in the event of take-out, are a successful implementation in dealing with counterfeit notes.

Figure 10:
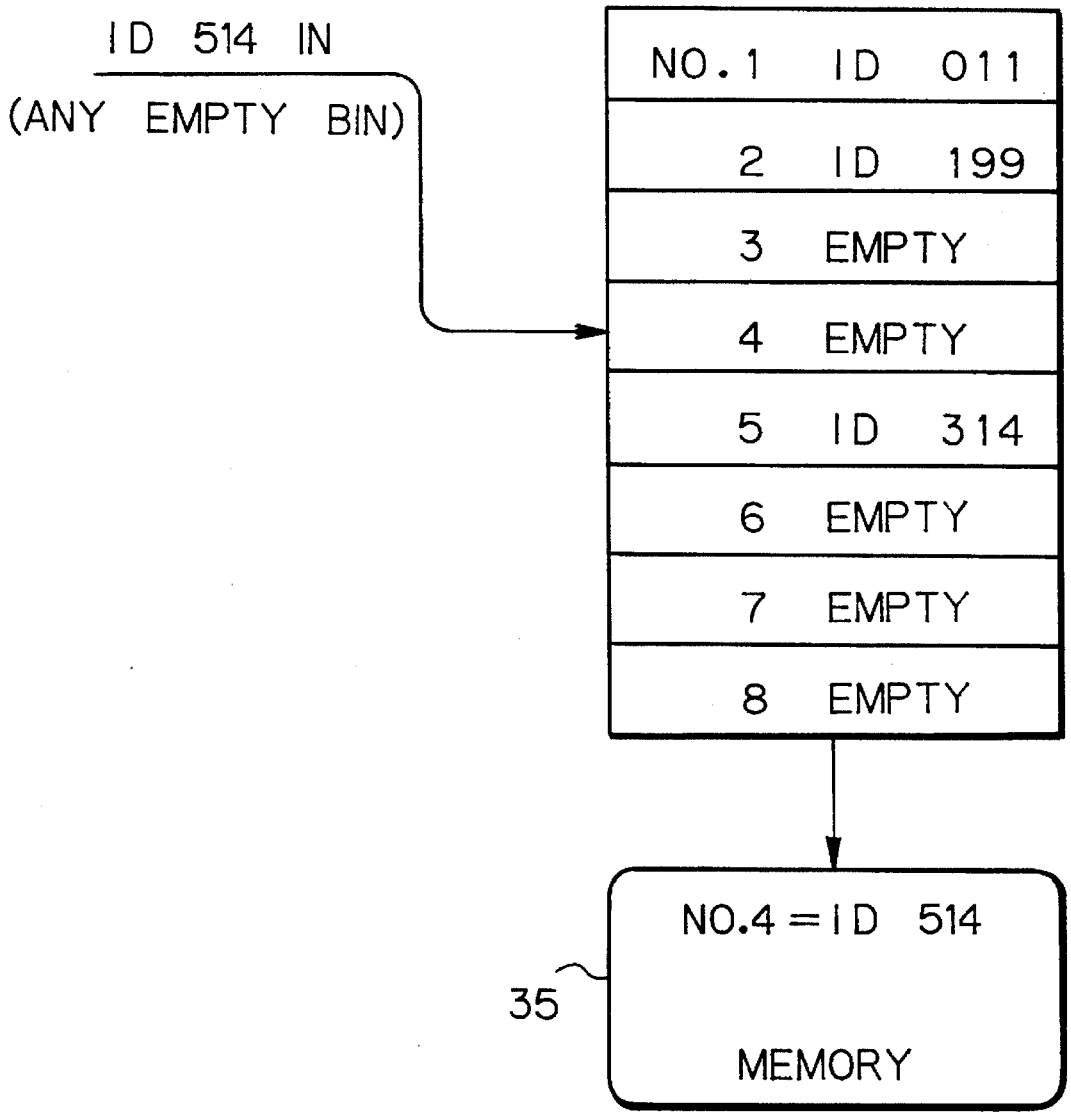
FIG. 10 shows a specific assignment using a memory.
Figure 11:
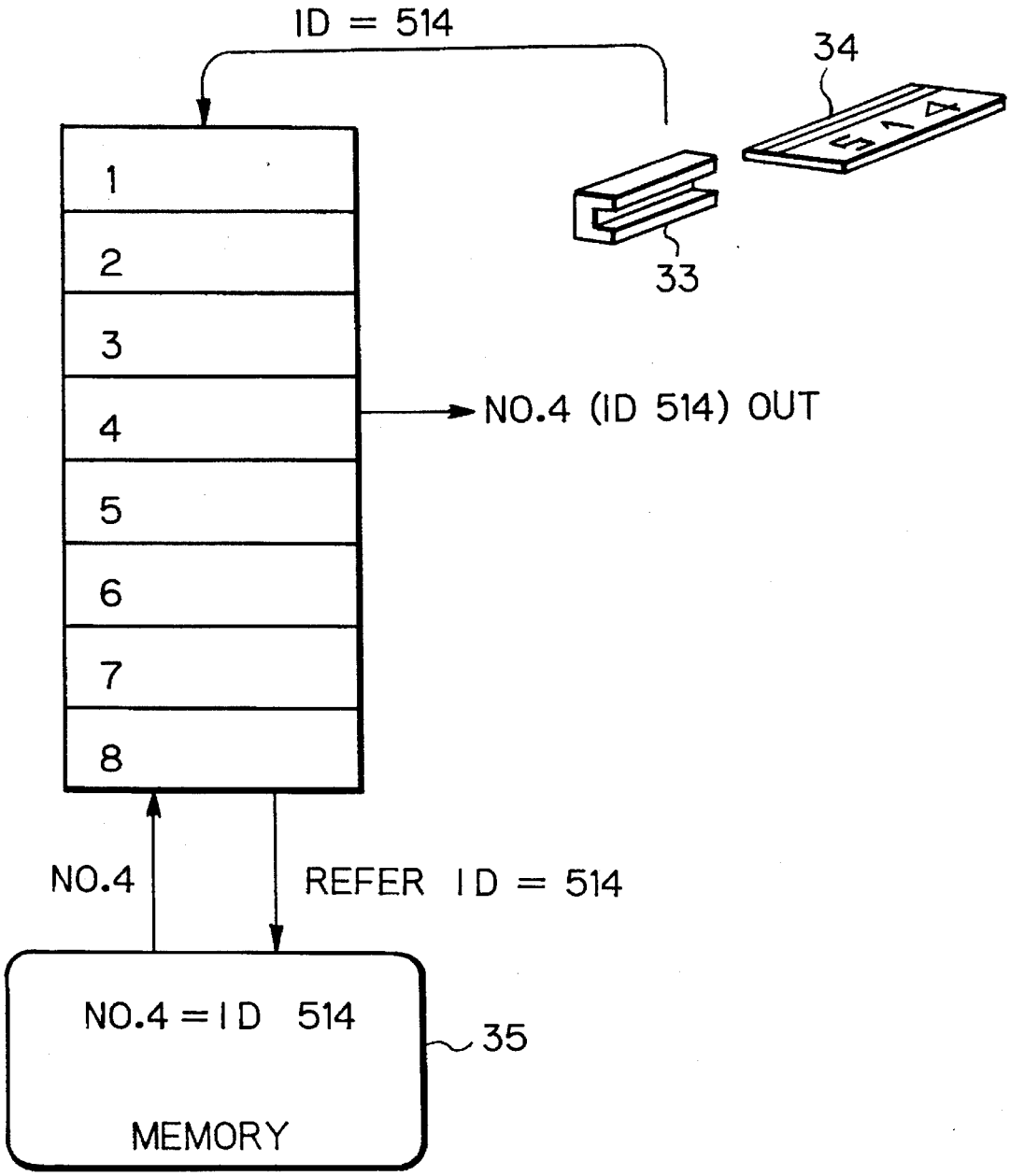
FIG. 11 shows how sheets are taken out by use of an ID card.

With the above assignment, it is impossible to accommodate a greater number of users than the number of the bins 16. To eliminate this problem, the assignment of sheet stacks and bins may be done in matching relation to the full/empty states of the individual bins 16, as follows. FIG. 10 shows a memory 35 storing a table representative of correspondence between the bins and the ID numbers of sheet stacks received in the bins. As shown in FIG. 11, a person intending to take out a sheet stack enters the ID number by passing the ID card 34 through the card reader 33, and then cause the corresponding sheet stack to be automatically taken out. This alternative scheme can assign the bins extemporaneously in the event of reception, thereby allowing sheet stacks to be stored safely. Of course, when all the bins are occupied, any further image formation cannot be performed. Hence, the number of bins should preferably be selected in conformity to the number of sheet stacks to be stored in practice.

The memory 35 should be implemented by a nonvolatile memory; otherwise, the contents of the memory 35 would be lost in the event of the turn-off of the power source or accidental power failure. Since the memory 35 does not need a great capacity, it may be constituted by any kind of memory, e.g., EEPROM, flush ROM, NVRAM, or SRAM backed up by a battery.

Figure 12:
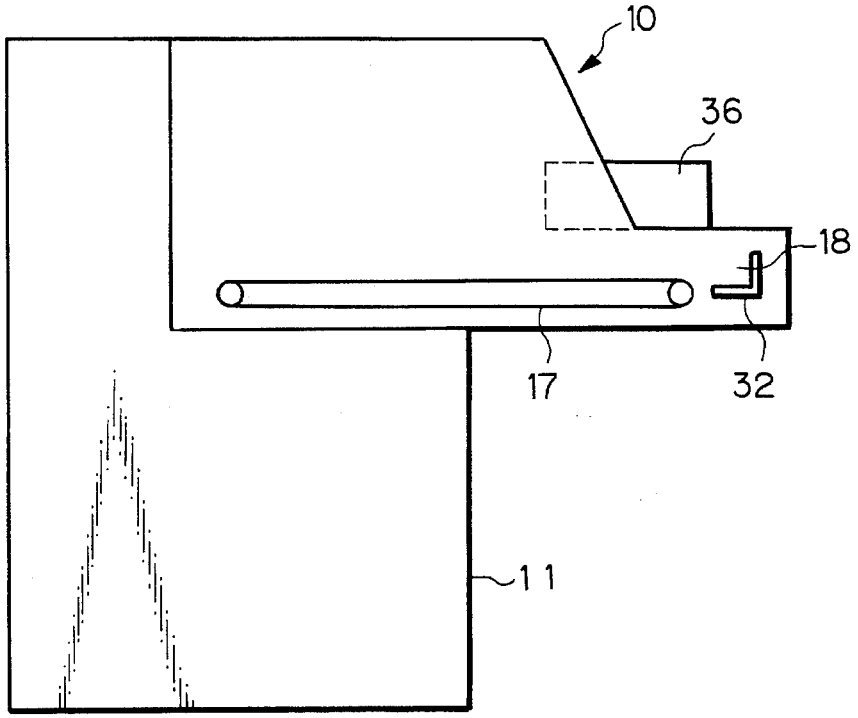
FIG. 12 is a side elevation showing the embodiment together with a stapler, puncher, jogger or similar finisher neighboring a sheet take-out opening included in the embodiment.

It has been customary to provide a sheet storing device with a plurality of sheet take-out openings to distinguish sheet stacks each being meant for a particular user. By contrast, the illustrative embodiment has a single take-out opening. Therefore, as shown in FIG. 12, a stapler, puncher, jogger or similar finisher 36 may be located in the vicinity of the opening 18 to offer various kinds of finishing services to all the users.

Figure 13:
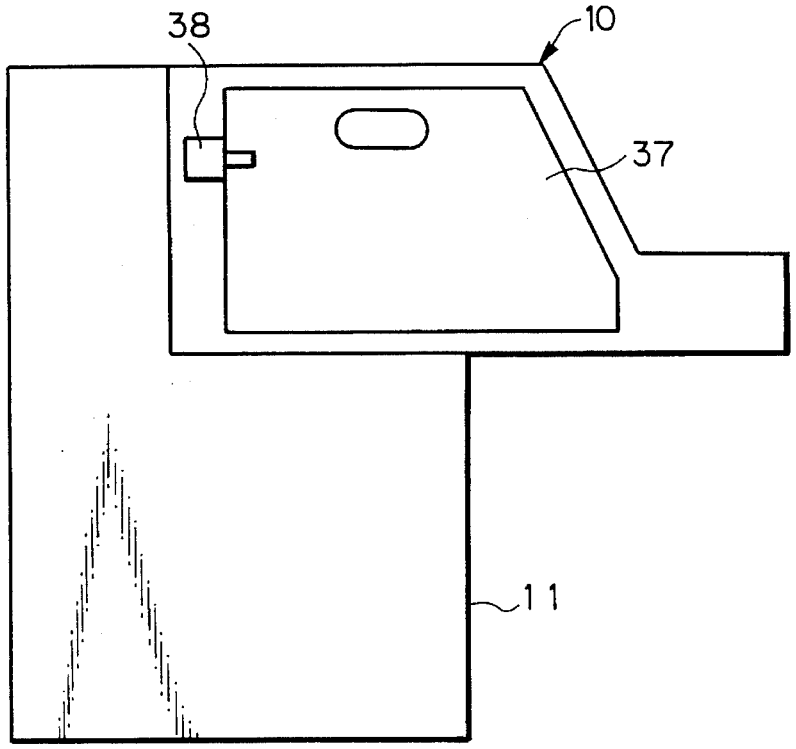
FIG. 13 is a side elevation of a lockable door included in the embodiment.

As shown in FIG. 13, a door 37 capable of uncovering the side edges of all the bins 16 at a time may advantageously be provided on the device 10 in order to facilitate maintenance, jam processing, etc. The prerequisite is that the door 37 be lockable by locking means 38 from the secrecy standpoint. The locking means 38 is managed by a system supervisor or a printer supervisor. Alternatively, an arrangement may be made such that even an ordinary user can unlock the door 37 by entering an ID number by use of a card. Further, the door 37 may be locked and unlocked electrically on the basis of an ID card and remote control.

Figure 14:
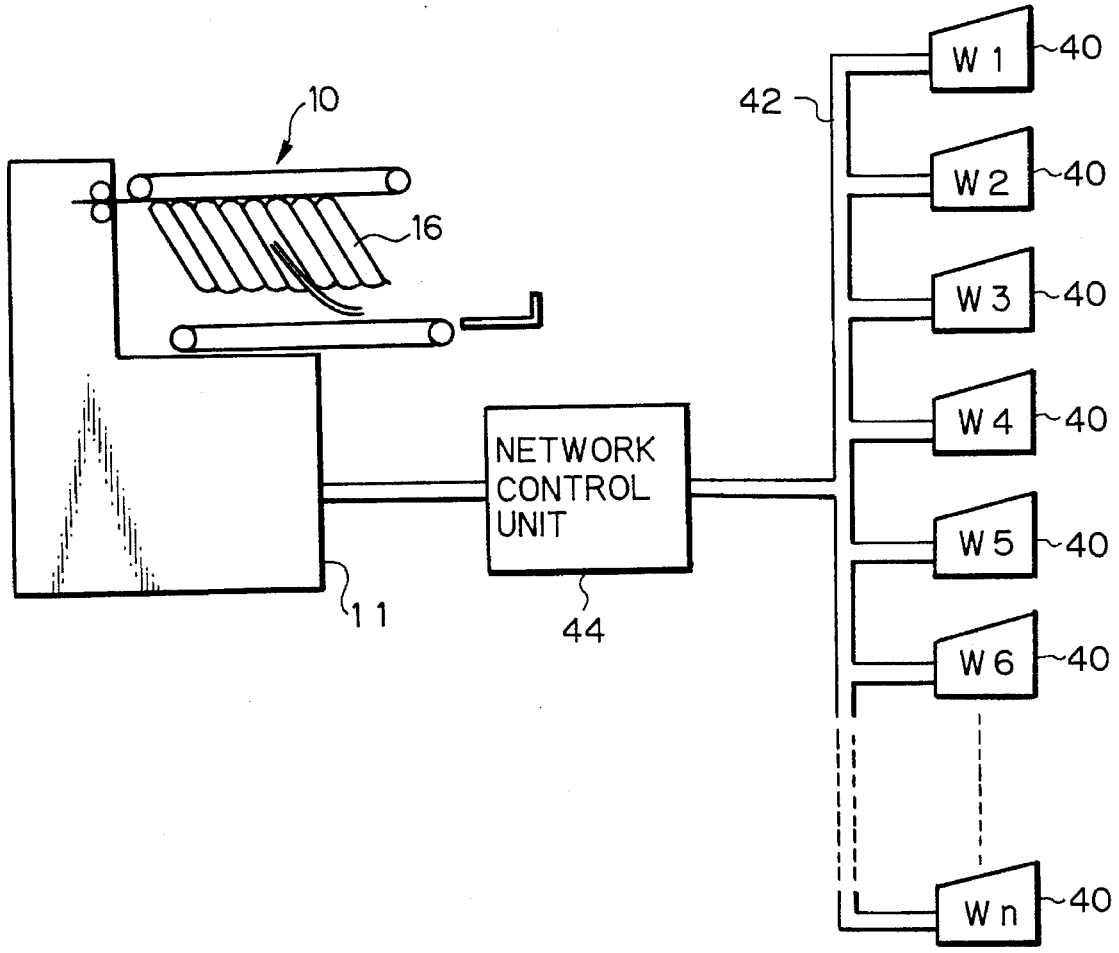
FIG. 14 schematically shows a network to which a printer implemented with the embodiment is connected.

As shown in FIG. 14, the printer or similar apparatus 11 with the sheet storing device 10 is connected by a network control unit 44 to a network 42 which accommodates a plurality of work stations or similar terminal units 40 (W1–Wn). The network control unit 44 controls the network 42 at all times and has a network monitoring function and a function of sending messages to the terminal units 40. A particular ID number is assigned to each terminal unit 40. When a user enters a print command meant for the printer 11 on the terminal unit 40, an ID number is entered together with print or image information. When printings should be distributed to a particular user, a destination ID number is entered together with print information. The sheets or printings coming out of the printer 11 are transported to the sheet storing device 11 in the previously stated manner. If any one of the bins 16 is empty, the sheets are distributed to and stored in the empty bin 16. At this instant, the number assigned to the empty bin and the entered ID number are stored in combination. When another print command is entered afterwards, the resulting sheets are delivered to another empty bin in the same manner as the previous sheets. Subsequently, the users entered print commands or to whom the sheets stacks are addressed each enters an ID number on the device 10 by, for example, passing an ID card through a card reader. Then, the device 10 identifies a bin corresponding to the ID number and opens the lower gate 23 of that bin. As a result, the sheets 14 are automatically transported from the bin of interest to the fence 32. This allows the user to take out the sheets 14 addressed to him rapidly; otherwise, the user has to search for a bin received the printings printed by or addressed to the user. Assume that none of the bins 16 are empty when the user has entered a print command on the terminal unit 40. Then, the printer 11 simply waits until a sheet stack has been removed from any one of the bins 16.

Figure 15:
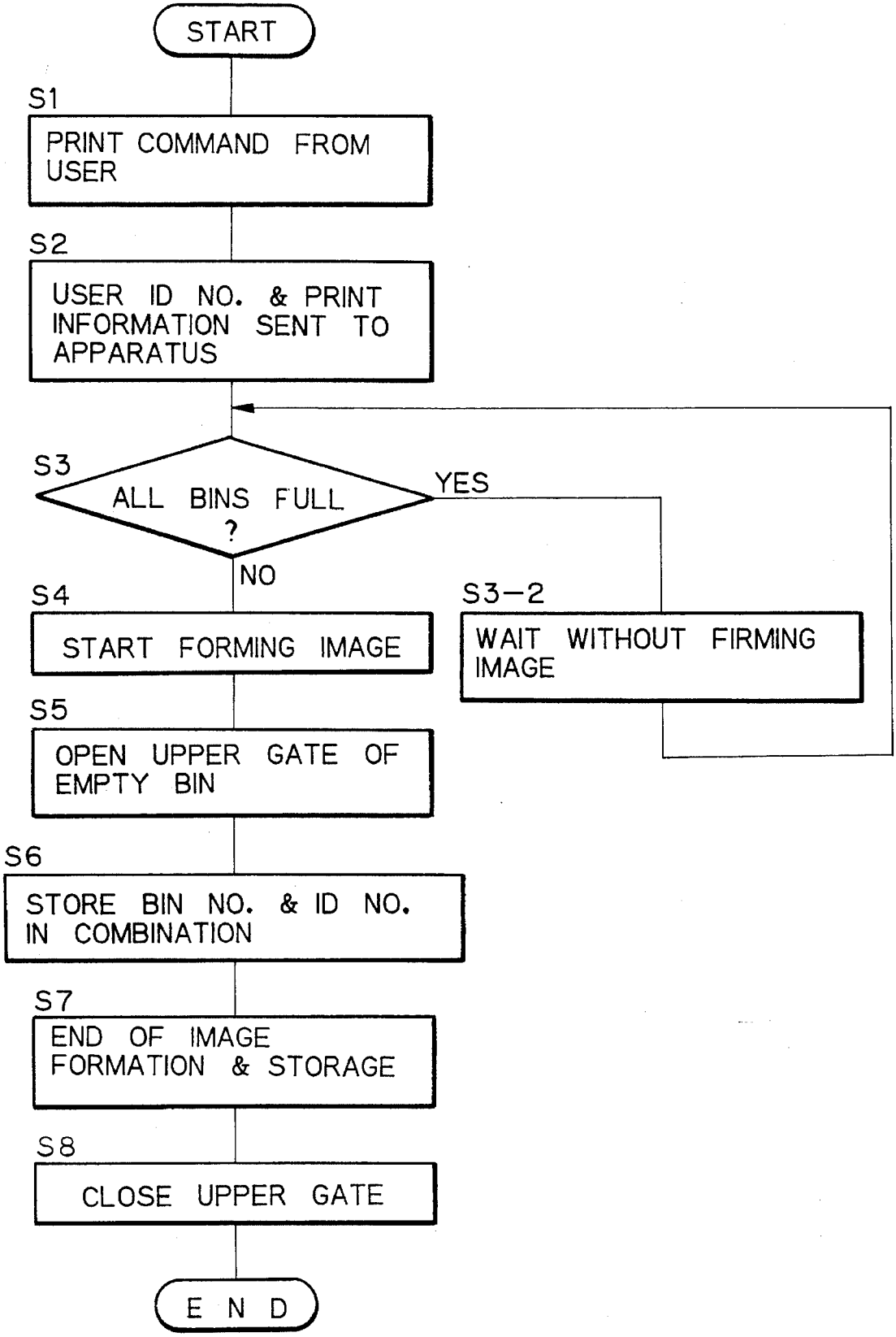
FIGS. 15 and 16 are flowcharts each showing a specific operation of the embodiment.

The above operation will be described more specifically with reference to FIGS. 15 and 16. FIG. 15 shows a procedure to occur when a user sends a print command to the printer 11. As shown, the user enters a print command (step S1). Then, a user ID number or a destination ID number is sent to the printer 11 together with image information (step S2). In response, whether or not all the bins 16 are full is determined (step S3). If no empty bin 16 is available (Y, step S3), the printer 11 simply waits without performing image formation (step S3-2), and then the program returns to the step S3. If one or more empty bins 16 are available (N, step S3), the printer 11 starts forming an image (step S4). Then, the upper gate 21 of an empty bin 16 is opened (step S5). Subsequently, a number assigned to the empty bin 16 selected and the ID number received by the printer 11 are stored in combination (step S6). The image formation by the printer 11 and the storage of sheets in the bin 16 end at a step S7. Finally, the routine ends after the upper gate 21 of the bin 21 has been closed (step S8).

Figure 16:
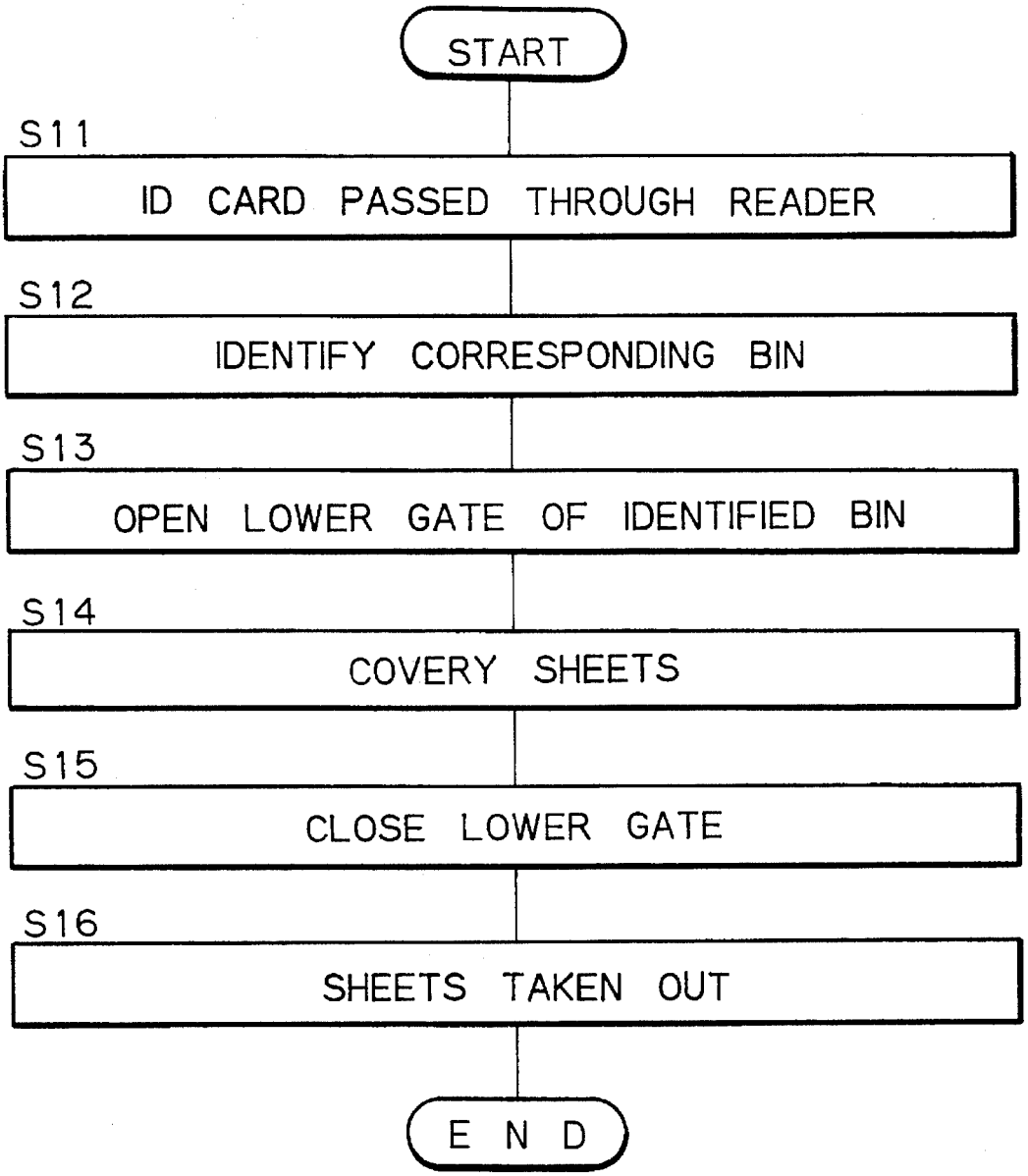

FIG. 16 shows a procedure to occur when the user takes out the printings or sheets 14 from the device 10. To begin with, the user passes an ID card through a card reader to enter an 1D number (step S11). In response, a bin 16 corresponding to the ID number is identified (step S12), and then the lower gate 23 of the bin 16 is opened (step S13). As a result, the sheets 14 are dropped from the bin 16 and then conveyed to the fence 32 (step S14). Subsequently, the lower gate 23 of the bin 16 is closed (step S15). In this condition, the user can take out the sheets 14 (step S16).

So long as one or more empty bins 16 are available in the device 10, printings, or job, specified by or addressed to a particular user are distributed to any one of the empty bins 16, discharged, and then stored. Hence, the printer 11 with the device 10 can be shared by a greater number of users than the number of bins 16.

Now, assume that users do not take out respective sheet stacks rapidly, maintaining all the bins 16 full. Then, they cannot use the printer with the device 10 as job separators or a mail boxes. This would limit the use of the printer 11 and critically obstruct office transactions. In light of this, the illustrative embodiment has a function of alerting the users to the full state of the bins 16, as follows.

Figure 17:
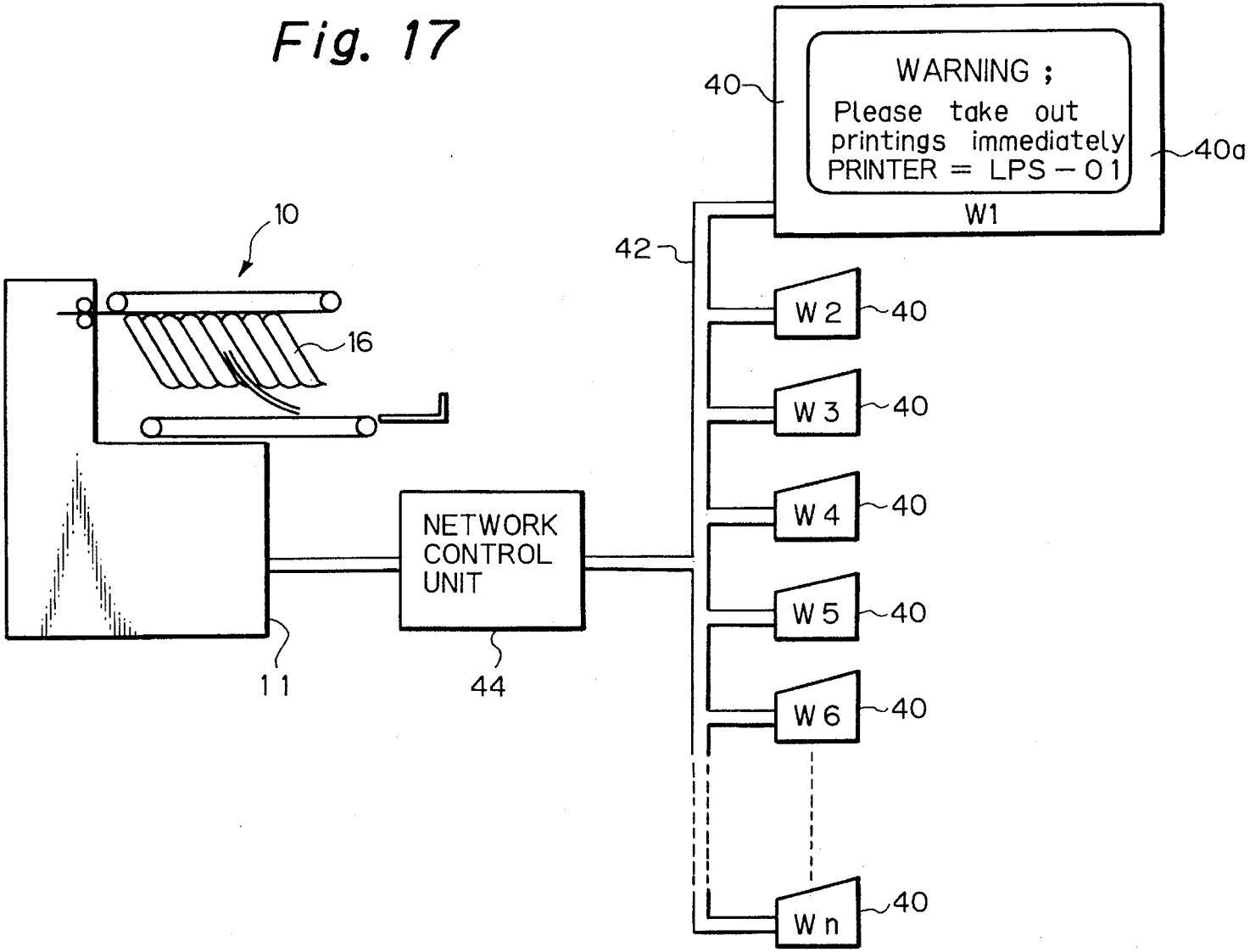
FIG. 17 shows a function available with the embodiment for reporting that all the bins are full.

As shown in FIG. 17, when all the bins 16 are full, a warning in the form of a message is displayed on a display 40*a* included in each terminal unit 40. The message is sent only to the terminals 40 represented by the ID numbers which have been stored in combination with the bins 16. More specifically, the message is sent only to the users who originated print commands associated with the full bins 16 or to the users to which the printings of the full bins 16 are addressed. If desired, the presence/absence of empty bins 16, the numbers assigned to full bins 16 and corresponding ID numbers, and other factors relating to the device 10 may be sent to the network control unit 44 which controls the network 42. Then, the warning can be sent to the terminal units 40 by software using the monitoring function and message sending function available with the network control unit 44.

Furthermore, the embodiment has a function of urging a user to take out sheets from a bin 16 when the sheets are left in the bin for more than a predetermined period of time. Generally, for the efficient operation of a sheet storing device, it is necessary to take out printings stored in the device as soon as possible. To this end, when a sheet stack has been left in any bin 16 for more than a predetermined period of time, the device 10 sends a warning to the user originated a print command or to whom the sheet stack is addressed, thereby urging the user to take out the sheet stack immediately.

Figure 18:
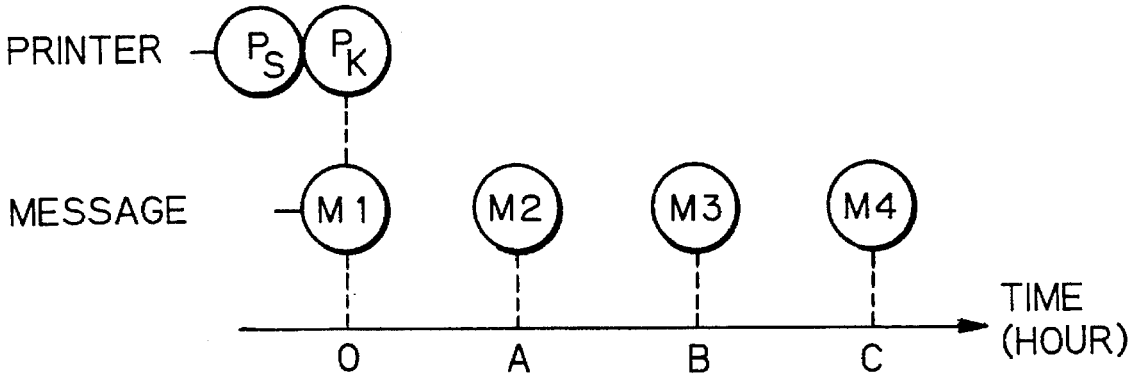
FIG. 18 is a diagram indicative of a relation between messages and time.
Figure 19:
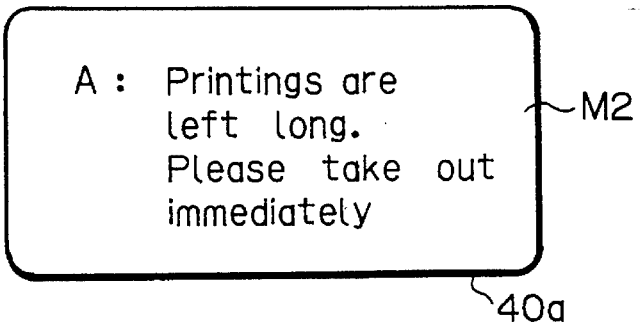
FIG. 19 is a front view showing a specific message.

Specifically, as shown in FIG. 18, assume that the user of a terminal unit 40 having a given ID number has entered a print command (Ps). Then, the resulting printings or sheets 14 are sequentially transported to and stored in any one of empty bins 16. When the printing operation is completed (Pk), a message M1 is sent to the terminal 40 originated the print command or to whom the printings are addressed. The message M1 appears on the display 40*a* of the terminal unit 40. Assume that the printings have been left in the bin 16 for more than a predetermined period of time A since the completion of printing operation (Pk), i.e., the appearance of the message M1. Then, as shown in FIG. 18, a second message M2 appears on the display 40*a* to urge the user to take out the printings from the bin 16. Whether or not the printings have been taken out from the bin 16 can be determined on the basis of whether or not the ID number corresponding to the bin 16 has been entered via, for example, an ID card. If the printings have been left in the bin 16 even on the elapse of a predetermined period of time B, a third message M3 appears on the display 40*a* to again urge the user to take out the printings from the bin 16. When a predetermined period of time C elapses without the printings being taken out from the bin 16, a warning M4 appears on the display 40*a*. In this way, the warning appearing on the display 40*a* becomes sharper with the elapse of time. This is successful in reducing the possibility that printings are left in the bins 16 for a long period of time, thereby enhancing the efficient operation of the device 10.

It is to be noted that the messages for urging the user to take out the finished print job 14 may be sent by the network control unit 44, as stated earlier.

Figure 20:
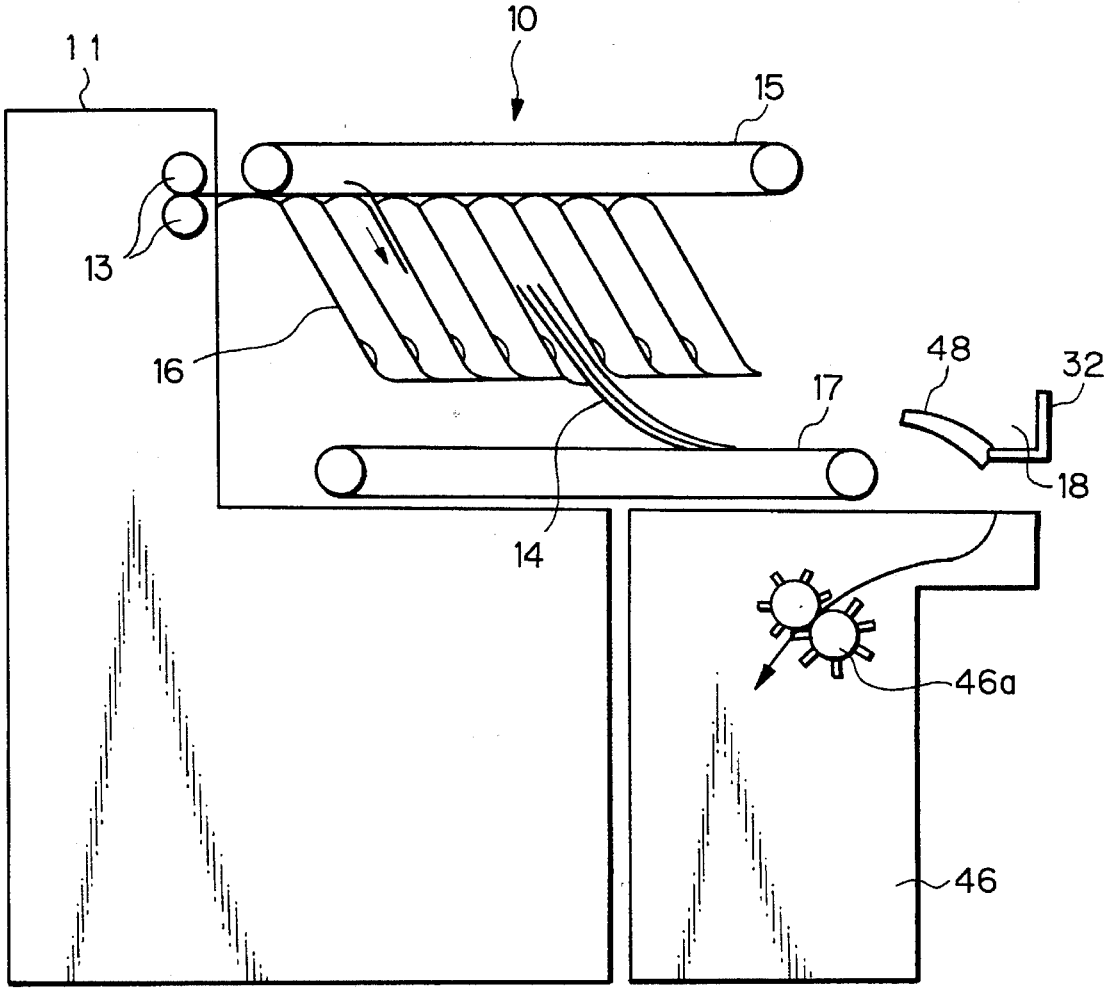
FIG. 20 is a side elevation of the embodiment further including a shredder.

As shown in FIG. 20, a shredder 46 is associated with the sheet storing device 10. Generally, it is quite likely that the printings 14 are left in the device 10 without being taken out when they become needless. Specifically, when the printings 14 commanded by a user become needless, the user is apt to leave them in the bin 16 of the device 10 without handing them rapidly. The device 10 is provided with the shredder 46 to deal with such an occurrence. As shown in FIG. 20, the shredder 46 is mounted on the side of the printer 11. A disposal gate 48 is positioned between the fence 32 and the lower conveyor belt 17 and rotatable about a shaft, not shown. Driven by drive means, not shown, the disposal gate 48 is rotatable between a position where it guides the sheets 14 conveyed by the belt 17 to the fence 32 and a position where it guides them to the shredder 46. A cutter roller 46*a* is included in the shredder 46 to cut the sheets 14 into pieces. When the user intending to dispose of the sheets 14 enters a disposal command on the terminal unit 40, the bin 16 corresponding to the user's ID number has the lower gate 23 thereof opened. As a result, the sheets 14 are dropped from the bin 16 onto the belt 17. At the same time, the disposal gate 48 is opened to guide the sheets 14 to the shredder 46. Consequently, the sheets 14 are cut into pieces by the cutter roller 46*a*.

As stated above, the device 10 shreds the needless sheets 14 without requiring the user to walk all the way to the device 10. Hence, the sheets 14, become needless due to the user's neglect, are prevented from being left in the bin 16 for a long time and, therefore, from lowering the operation efficiency of the device 10. If desired, a person supervising the network system may forcibly dispose of the printings 14 left in the bins 6. Then, a disposal command can, of course, be entered on the terminal unit 40 allocated to the system supervisor.

While the illustrative embodiment has concentrated on a printer or copier, the device 10 may also be mounted on any other image forming device, e.g., facsimile apparatus. For example, assume that the device 10 is mounted on a facsimile apparatus having a confidential function. Then, if a person at the transmitting station enters an ID number assigned to a recipient after the destination's telephone number, the bins 16 of the device 10 can be used as mail boxes, i.e., printings from the facsimile apparatus can be stored in the bins, or mail boxes, 16. The recipient will take them out afterwards by using an ID card or similar implementation.

In summary, it will be seen that the present invention provides a sheet storing device having various unprecedented advantages, as enumerated below.

(1) Since bins are each inclined from a top sheet inlet to a bottom sheet outlet, sheets can be introduced and discharged from the bins by gravity.

(2) Sheet tacks from a plurality of bins are transported to a sheet take-out opening by single sheet transporting means. This reduces the number of parts of the device and, therefore, the size, weight and cost of the device.

(3) A sheet stack bodily discharged from each bin by gravity can be collectively moved to the sheet take-out opening without being damaged and can be taken out surely and rapidly. Further, despite that the device has a plurality of bins, users can take out sheets from a single take-out opening without perplexity.

(4) A simple fence located at the sheet take-out opening can neatly arrange the leading edge of a sheet stack automatically, making the stack easy to take out.

(5) Lower gates are each associated with a respective bin and opened when a particular ID number is input. Users, therefore, do not have to remember their own bin numbers and are prevented from taking out sheets stacks addressed to other users by accident or from having sheet stacks addressed to them taken out by the others.

(6) Since the bin and user assignment is supervised on an ID number basis, the device can deal with a greater number of users than the number of bins.

(7) A stapler, puncher, jogger or similar finisher can be located in the vicinity of a single sheet take-out opening. This offers various kinds of finishing services to all the users.

(8) Maintenance, jam processing and others can be effected only if a single door covering all the bins is opened. In addition, the door can be locked for secrecy.

(9) When all the bins are full, such a condition is selectively reported to the users. As a result, the users are urged to take out their sheets from the trays, enhancing the efficient operation of the device.

(10) Users having left their sheets in the trays for a long period of time are alerted by a warning message. This also enhances the efficient operation of the device.

(11) Sheets become needless for the users can be disposed of by commands from user stations. This reduces the number of printings to be left in the bins due to neglect and, again, enhances the efficient operation of the device.

Various modifications will become possible for those skilled in the art after receiving the teachings of the present disclosure without departing from the scope thereof.

What is claimed is:

1. A sheet storing device comprising:

a plurality of inclined bins each for storing incoming sheets while sorting said sheets;

sheet introducing means disposed between said bins for selectively introducing the sheets into said plurality of bins; and sheet discharging means disposed between said bins for selectively discharging the sheets from said plurality of bins;

said sheet introducing means and said sheet discharging means being operable asynchronously to each other; and selective opening means for controlling the selective discharge from a given bin responsive to the receipt of an ID number assigned to a bin being entered into said sheet storing device.

2. A device as claimed in claim 1, wherein said sheet introducing means is disposed above said bins and comprises an upper conveyor belt for conveying the sheets to said sheet inlets, and movable upper gates for selectively guiding said sheets into said bins.

3. A device as claimed in claim 2, wherein said upper conveyor belt comprises a plurality of parallel belts spaced apart a predetermined distance from each other, said upper gates being each interposed between said plurality of parallel belts and driving the sheets by holding said sheets between said upper gates and said upper conveyor belt.

4. A device as claimed in claim 1, wherein said sheet discharging means is disposed below said bins and comprises a lower conveyor belt for selectively discharging the sheets from said bins to the outside of said device, and lower gates for selectively opening or closing the sheet outlets of the respective bins.

5. A device as claimed in claim 4, wherein said lower gates guide the sheets from said bins to said lower conveyor belt when the sheet outlets are opened.

6. A device as claimed in claim 1, further comprising a sheet stack control device for allocating said bins to sheet stacks on the basis of full/empty states of said bins.

7. A device as claimed in claim 6, wherein said sheet stack control device comprises recording means for recording the bins received sheet stacks and ID numbers given to said sheet stacks in one-to-one correspondence, said sheet stack control device discharging, in response to the ID number, one of said sheet stacks corresponding to said ID number.

8. A device as claimed in claim 1, further comprising a single sheet take-out opening located at an end of said sheet discharging means and shared by said bins, a stapler, a puncher, a jogger or similar finishing device being located in the vicinity of said sheet take-out opening.

9. A device as claimed in claim 1, further comprising a door movable to allow the sheets to be taken out from all of said bins at a time.

10. A device as claimed in claim 1, further comprising reporting means for reporting that said bins are full.

11. A device as claimed in claim 10, further comprising warning means for urging, when the sheets are left in any one of said bins for more than a predetermined period of time, a user associated with said bin to take out said sheets.

12. A device as claimed in claim 1, further comprising discarding means for discarding the sheets left in said bins.

* * * * *